US008132282B2

(12) United States Patent
Arsenault et al.

(10) Patent No.: US 8,132,282 B2
(45) Date of Patent: Mar. 13, 2012

(54) MECHANICAL SWEEPER

(75) Inventors: Michel Arsenault, Trois-Rivières (CA); Stéphane Arsenault, Trois-Rivières (CA)

(73) Assignee: 9089-1557 Quebec Inc. (Entretien de Stationnement M.A.), Trois-Rivieres, QC (CA)

( * ) Notice: Subject to any disclaimer, the term of this patent is extended or adjusted under 35 U.S.C. 154(b) by 993 days.

(21) Appl. No.: 12/109,147

(22) Filed: Apr. 24, 2008

(65) Prior Publication Data

US 2009/0265870 A1 Oct. 29, 2009

(51) Int. Cl.
*E01H 1/04* (2006.01)

(52) U.S. Cl. ..... 15/84; 15/83; 414/345; 414/398; 414/489; 414/505; 198/312; 198/313; 198/314

(58) Field of Classification Search ..... 15/78, 79.1, 15/79.2, 82–87; 414/345, 398, 489, 501, 414/503, 505; 198/312, 313, 314, 315, 317, 198/318

See application file for complete search history.

(56) References Cited

U.S. PATENT DOCUMENTS

| | | | | | |
|---|---|---|---|---|---|
| 2,888,130 | A * | 5/1959 | Mousel | 198/632 |
| 4,290,820 | A * | 9/1981 | Swisher et al. | 134/6 |
| 5,060,334 | A * | 10/1991 | Strauser et al. | 15/84 |
| 5,113,548 | A * | 5/1992 | Young et al. | 15/346 |
| 5,197,211 | A * | 3/1993 | Haug | 37/305 |
| 6,029,764 | A * | 2/2000 | Schubert | 180/89.13 |
| 6,371,565 | B1 * | 4/2002 | Libhart | 298/11 |
| 6,966,097 | B2 * | 11/2005 | Engel et al. | 15/348 |
| 7,086,118 | B2 * | 8/2006 | Engel et al. | 15/340.4 |

* cited by examiner

*Primary Examiner* — Mark Spisich
*Assistant Examiner* — Michael Jennings
(74) *Attorney, Agent, or Firm* — Fasken Martineau DuMoulin LLP; Alexandre Abecassis

(57) ABSTRACT

The present invention generally pertains to a self-propelled mechanical sweeper. The mechanical sweeper comprises a pickup broom for lifting debris toward a first belt conveyor. The sweeper further comprises a second deployable conveyor assembly mounted on a turntable and adapted for conveying the debris from the first conveyor to an auxiliary vehicle such as a dump truck.

16 Claims, 12 Drawing Sheets

MECHANICAL SWEEPER

FIELD OF THE INVENTION

The present invention generally relates to a mechanical sweeper. More specifically, the present invention relates to a mechanical sweeper comprising a deployable conveyor for conveying debris toward an auxiliary vehicle.

BACKGROUND OF THE INVENTION

Debris including litter, dust, sand, gravel and abrasive used during winter time and the like are often found on roads, parking lots, airport runways and other surfaces aimed at circulation of vehicles. Since debris may damage vehicles circulating on such surfaces and/or impair the security of the passengers thereof, removal of sand, gravel and the like from road surfaces has become very common.

Amongst the most common technologies developed for removing debris from road surfaces are the self-propelled sweeper vehicles. Typically, such vehicles are provided with a rotary brush for lifting the debris toward a container, where the debris are captured. A conveyor such as a vacuum conveyor or a belt conveyor then carries the debris from the container, toward a recipient or reservoir mounted in the vehicle, where the debris are stored. Once the reservoir has been substantially filled with the debris, the vehicle travels to a landfill or depot, where the reservoir is emptied.

The quality of cleaning of these types of systems tend to be satisfactorily in that minimal amounts of debris are found on such surface after the passage of the vehicle. However, the efficiency of these systems is greatly reduced by the limited size of the debris reservoir, involving frequent interruption of sweeping activities for the vehicle to travel back and forth to the landfill areas. In some cases, the travel time may represent up to 75% of the operation time of the vehicle while cleaning operation per se only represents 25%. As such, traditional sweepers tend not to be cost effective.

To minimize travel time of the sweeping vehicles, other vehicles such as dump truck may be brought to the cleaning sites. In these occasions, the debris reservoir of the sweeping vehicle is emptied into the dump truck, which will further deliver the debris to the landfill. Although this mode of operation considerably reduces travel time, interruption of the cleaning activities is still required and efficiency of the sweeping vehicles still not optimized.

To avoid the need for emptying debris reservoirs, some have proposed mechanical sweepers provided with conveyor assemblies for carrying the debris from the road directly towards another vehicle. For instance, some have come with a mechanical sweeper towed by a vehicle such as a dump truck. Such a mechanical sweeper comprises a pickup broom transferring debris on a first conveyor belt, which in turn transfers the material on a second conveyor belt. The second conveyor belt conveys the material into the dump body of the dump truck. Because the sweeper is towed by a vehicle, it must be detached from the vehicle when the latter is full or, alternatively, be brought to disposal site. In any event, operating or cleaning time tends to be reduced by any of these additional operations.

Some others have come with self-propelled mechanical sweepers. Such mechanical sweepers of the prior art comprise a pickup broom transferring debris toward an auger (i.e. an endless screw), which directs the debris on a first belt. A second belt conveyor carries the debris from the first conveyor toward an auxiliary vehicle. Larger debris found on roads (i.e. rocks, plastic bottles, wheel covers) tend to remain jammed in the auger and impair proper functioning of the sweeper. Further, the mechanical sweepers of the art need to be transported from one cleaning site to another on a truck or a trailer as they tend to be very slow.

Therefore, it would be desirable to be provided with a mechanical sweeper capable of independently and efficiently traveling between cleaning sites and capable of handling relatively large debris.

SUMMARY OF THE INVENTION

In order to address the above and other drawbacks, and in accordance with the present invention, there is disclosed a self-propelled mechanical sweeper for cleaning debris from a surface.

According to one embodiment, there is provided a mechanical sweeper comprising a frame mounted on wheels for motion on the surface and a pickup broom assembly mounted to the frame for lifting the debris from the surface. The mechanical sweeper also comprises a first belt conveyor mounted to the frame for collecting the debris lifted by the pickup broom assembly and conveying the same away from the surface, and a deployable conveyor assembly mounted to the frame and operable for conveying debris conveyed by the first conveyor toward another vehicle.

The deployable conveyor assembly comprises a first conveyor portion comprising a coupling means and a second conveyor portion mounted to the first conveyor portion via the coupling means. The coupling means enables movement of the second portion relative to the first portion between a folded position and an extended position. The deployable conveyor assembly further comprises at least one belt operatively mounted on the first conveyor portion and the second conveyor portion and operable for motion thereon.

An actuator assembly is mounted to the deployable belt conveyor for urging the movement of the second conveyor portion between the folded position and the extended position. Further, a drive assembly is mounted to the frame of the mechanical sweeper for driving operation of the pickup broom, the first belt conveyor, the deployable conveyor assembly and the actuator assembly.

According to one aspect, the first conveyor portion comprises a first end and a second opposed end. The second conveyor portion also comprises a first end and a second opposed end. The first end of the second conveyor portion is connected to the second end of the first conveyor portion via the coupling means, the coupling means being preferably a hinge assembly or a slide mechanism.

According to another aspect, the mechanical sweeper further comprises at least one gutter broom assembly. The at least one gutter broom is mounted to the frame for rotation about a vertical axis and is operable to contact the surface and to direct debris toward the pickup broom assembly.

According to yet another aspect, the mechanical sweeper further comprises a deflector. The deflector is mounted to the frame and adapted for controlling the movement of the debris directed by the at least one gutter broom and directing the same toward the pickup broom assembly.

According to a further aspect, the mechanical sweeper further comprises an operator cab mounted to the frame. The operator cab is preferably mounted to the frame for movement between a lower position and an upper position and the mechanical sweeper may further comprise an actuator assembly for urging movement of the operator cab between the lower position and the upper position.

According to yet a further aspect, the deployable conveyor assembly is mounted to the frame for pivot movement about a vertical axis. The vertical axis is preferably located proximal to the first end of the deployable conveyor assembly. The mechanical sweeper may further comprise an actuator assembly for urging pivoting of the deployable conveyor assembly about the vertical axis.

According to another aspect, the deployable conveyor assembly is mounted to the frame for pivot movement about a horizontal axis, the horizontal axis being preferably located proximal to the first end of the deployable conveyor assembly. The mechanical sweeper may further comprise an actuator assembly for urging pivoting of the deployable conveyor assembly about the horizontal axis.

According to another embodiment, there is provided a deployable conveyor assembly for a mechanical sweeper. The deployable conveyor assembly comprises a first conveyor portion comprising a coupling means and a second conveyor portion mounted to the first conveyor portion via the coupling means. The coupling means enables movement of the second portion relative to the first portion between a folded position and an extended position. At least one belt is operatively mounted on the first conveyor portion and the second conveyor portion and is operable for motion thereon. The deployable conveyor assembly further comprises an actuator assembly connected to the first conveyor portion and the second conveyor portion for movement of the second conveyor portion between the folded position and the extended position.

According to one aspect, the first conveyor portion comprises a first end and a second opposed end. The second conveyor portion also comprises a first end and a second opposed end. The first end of the second conveyor portion is connected to the second end of the first conveyor portion via the coupling means, where the coupling means is preferably a hinge assembly.

According to yet another embodiment, a self-propelled mechanical sweeper for cleaning debris from a surface is provided. The mechanical sweeper comprises a frame mounted on wheels for motion on the surface and a pickup broom assembly mounted to the frame for lifting the debris from the surface. The mechanical sweeper further comprises a first belt conveyor mounted to the frame for collecting the debris lifted by the pickup broom assembly and conveying the same away from the surface and a deployable conveyor assembly.

The deployable conveyor assembly is mounted to the frame and is operable for conveying debris conveyed by the first conveyor toward another vehicle. The deployable conveyor assembly comprises a first conveyor portion comprising a first end mounted to the frame and a second opposed end comprising a hinge assembly. The deployable conveyor assembly also comprises a second conveyor portion comprising a first end connected to the hinge assembly and a second end for pivoting relative to the first conveyor portion between a folded position and an extended position, and a belt operatively mounted on the first conveyor portion and the second conveyor portion and operable for continuous motion thereon. An actuator assembly is mounted to the deployable belt conveyor for urging pivot of the second conveyor portion between the folded position and the extended position.

According to this embodiment, the mechanical sweeper also comprises a drive assembly mounted to the frame for driving operation of the pickup broom, the first belt conveyor, the deployable conveyor assembly and the actuator assembly.

These and other objects, advantages and features of the present invention will become more apparent to those skilled in the art upon reading the details of the invention more fully set forth below.

BRIEF DESCRIPTION OF THE DRAWINGS

Having thus generally described the nature of the invention, reference will now be made to the accompanying drawings, showing by way of illustration an illustrative embodiment thereof, and in which.

DESCRIPTION OF THE ILLUSTRATIVE EMBODIMENTS

Figure 1:
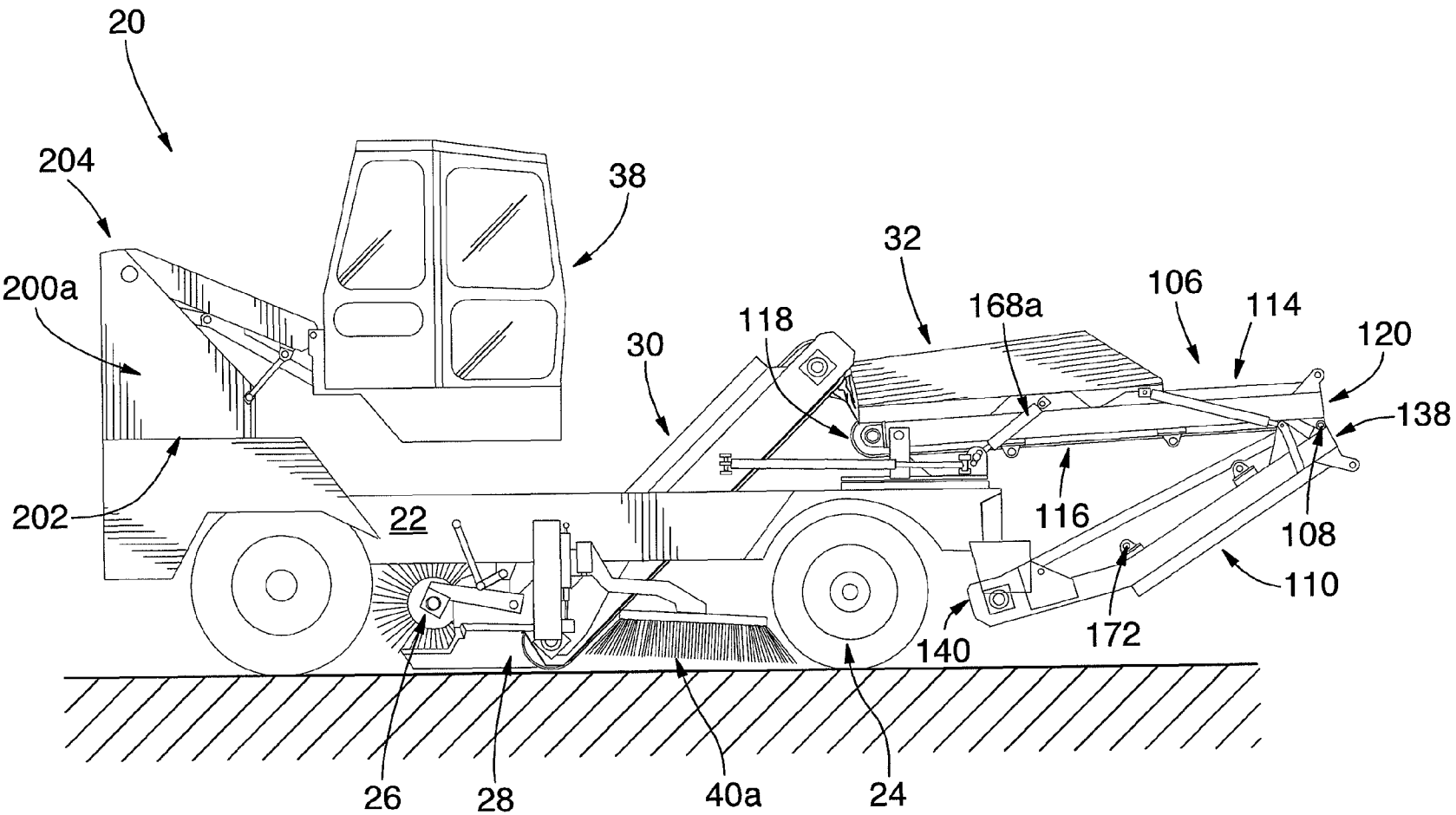
FIG. 1 is a right elevation view of a mechanical sweeper in accordance with one embodiment of the present invention, showing the deployable conveyor assembly in fully folded configuration.

The description which follows, and the embodiments described therein are provided by way of illustration of an example, or examples of particular embodiments of principles and aspects of the present invention. These examples are provided for the purpose of explanation and not of limitation, of those principles of the invention. In the description that follows, like parts are marked throughout the specification and the drawings with the same respective reference numerals.

Figure 2:
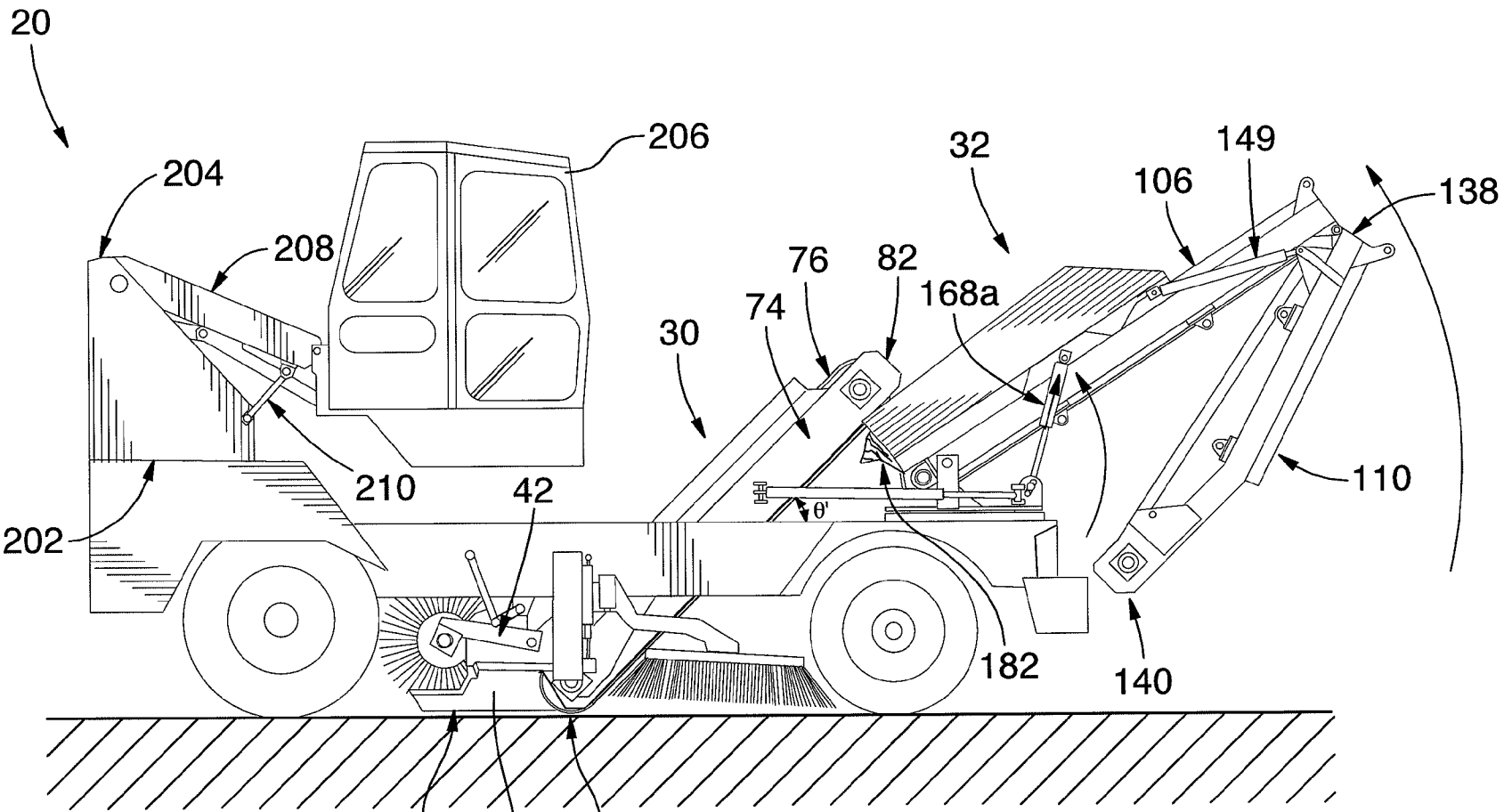
FIG. 2 is another right elevation view of the mechanical sweeper shown in FIG. 1, with the back portion of the deployable conveyor assembly in an upper position and the front portion thereof folded.
Figure 3:
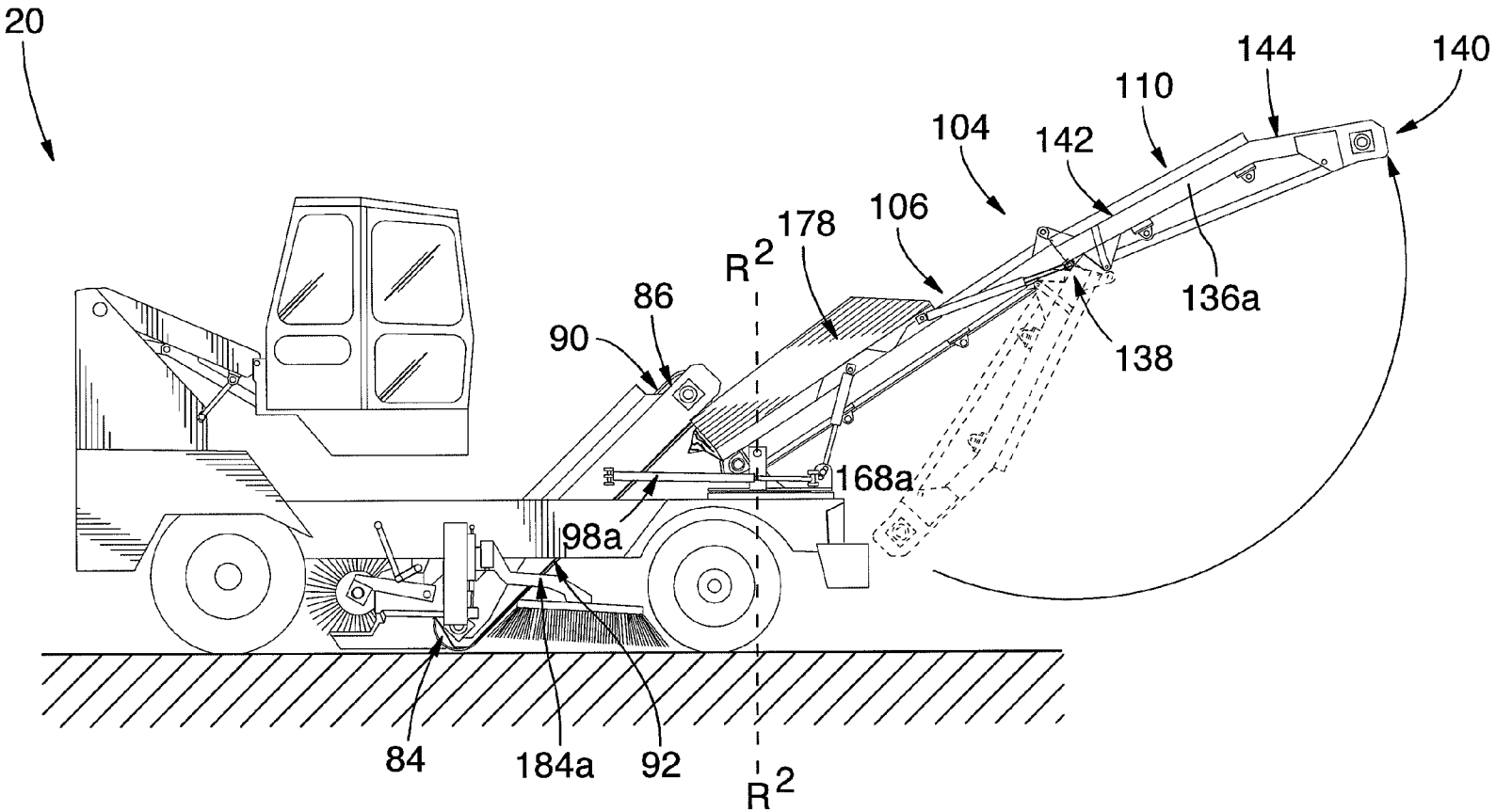
FIG. 3 is a further right elevation view of the mechanical sweeper shown in FIG. 1, with the deployable conveyor assembly in a fully deployed configuration.

With reference to FIGS. 1 to 3, a mechanical sweeper in accordance with one embodiment of the present invention is shown using the reference numeral 20. The sweeper 20 comprises a frame 22 mounted on wheels 24 for movement on a surface such as a road, a parking lot an airport runway and the like. The sweeper 20 further comprises pickup broom assembly 26 mounted on the frame 22, between the front and back wheels 24, a pickup receptacle assembly 28 for receiving the debris lifted by the pickup broom assembly 26 and a first conveyor assembly 30 mounted to the frame 22 and operable for collecting the debris from the receptacle assembly 28 and to move them upwardly, toward a second conveyor assembly 32. As it will become apparent below, the second conveyor assembly 32 is adapted for conveying the debris from the first conveyor assembly 30 in a container carried by another, auxiliary vehicle such as, for instance, a dump truck 34 (shown in FIGS. 9 and 10).

Figure 7:
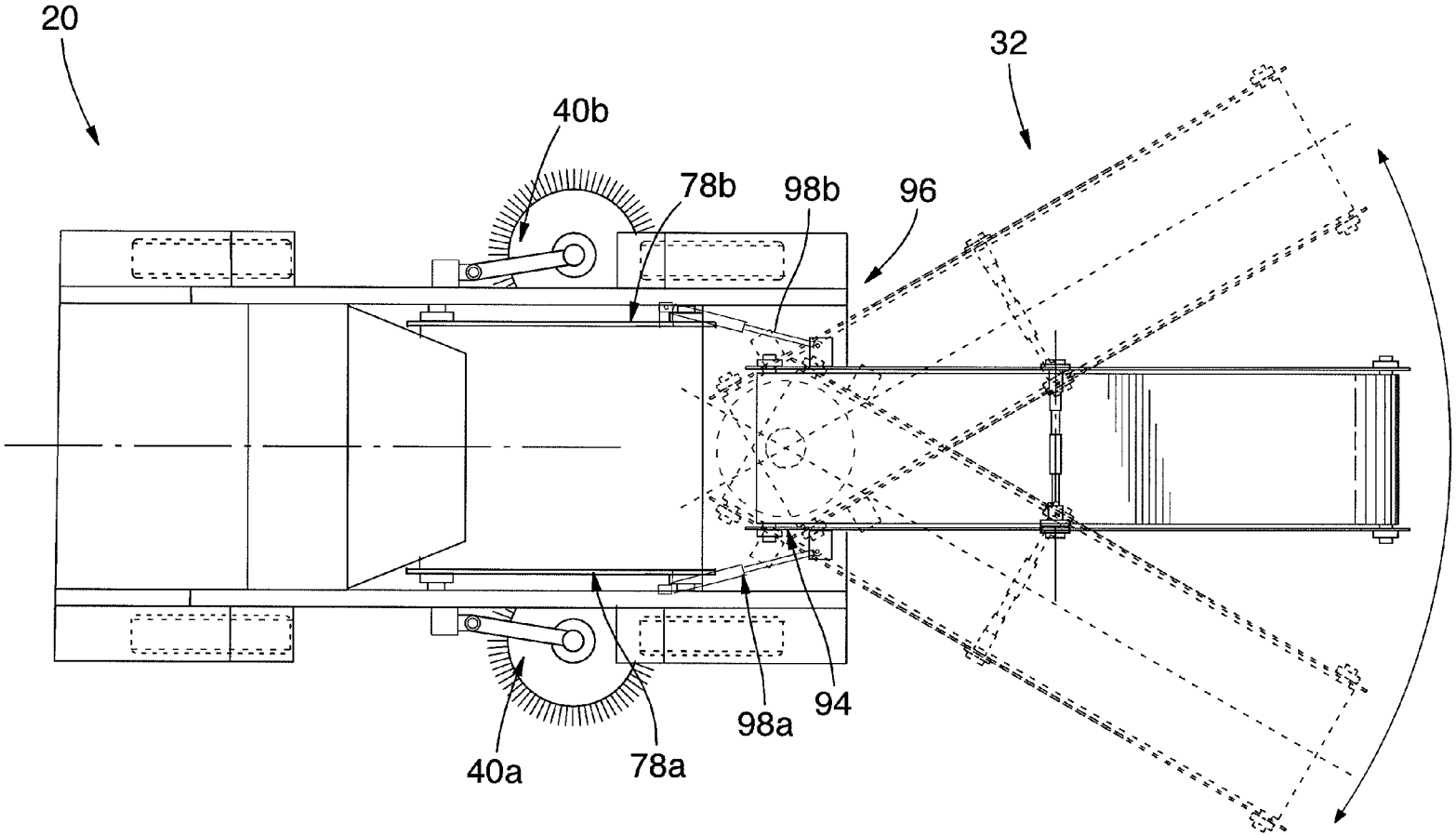
FIG. 7 is a top plan view of the mechanical sweeper showing the deployable belt conveyor from moving between the left and right sides the mechanical sweeper to the other side, in accordance with one embodiment of the present invention.

The sweeper 20 also comprises a drive assembly (not shown) mounted on the frame 22 and operatively coupled to the wheels 24, the pickup broom assembly 26 and the first and second conveyor assemblies 30 and 32, for driving operation thereof as it will become apparent below. In one embodiment, the sweeper 20 is further provided with an actuated cab assembly 38 for controlling the operation of the sweeper 20 and with gutter brooms assemblies 40*a*, 40*b* on each side of the frame 22, for directing debris toward the pickup broom assembly 26 during operation of the sweeper 20 (as shown in FIGS. 7 and 11).

Figure 4:
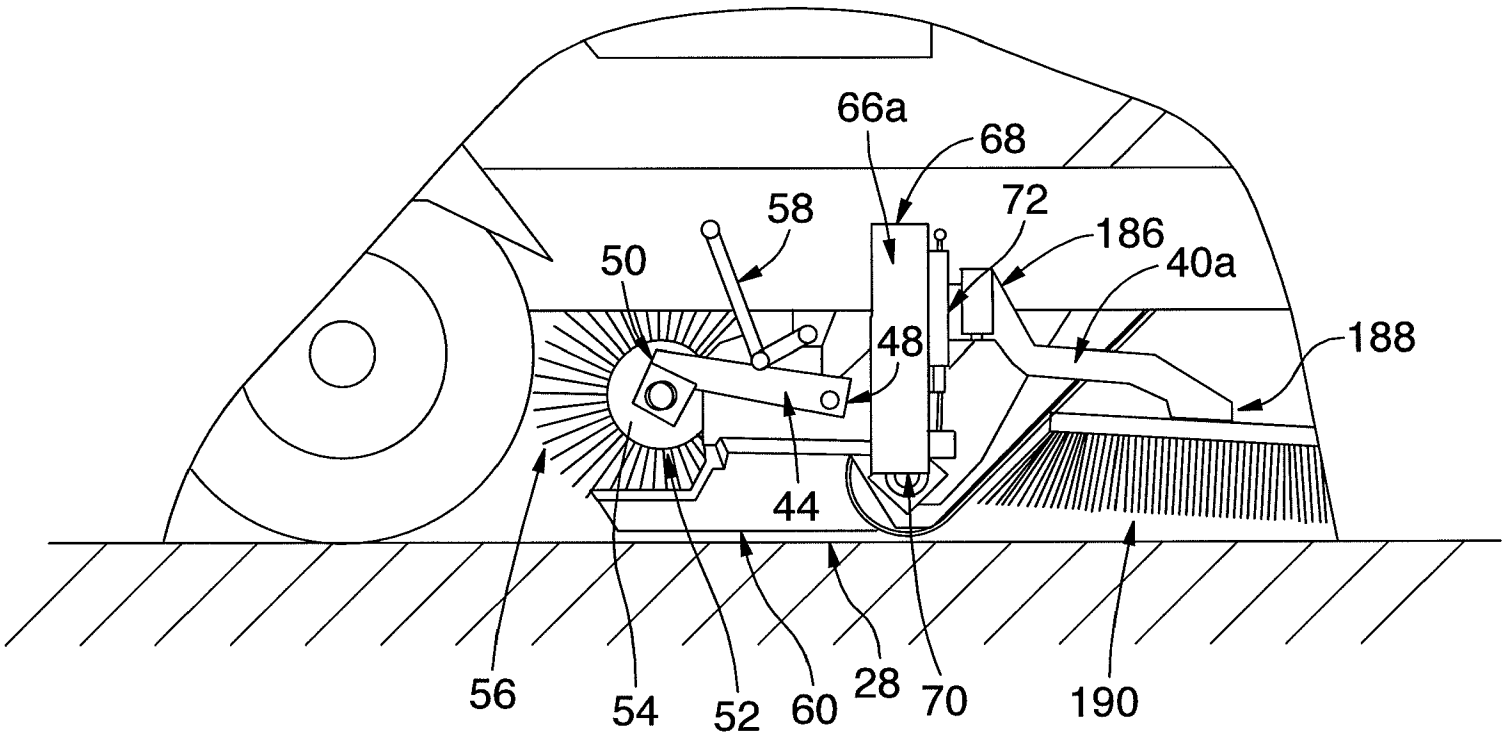
FIG. 4 is an enlarged right side view of the pickup broom assembly and receptacle assembly of the mechanical sweeper shown in FIG. 1.
Figure 11:
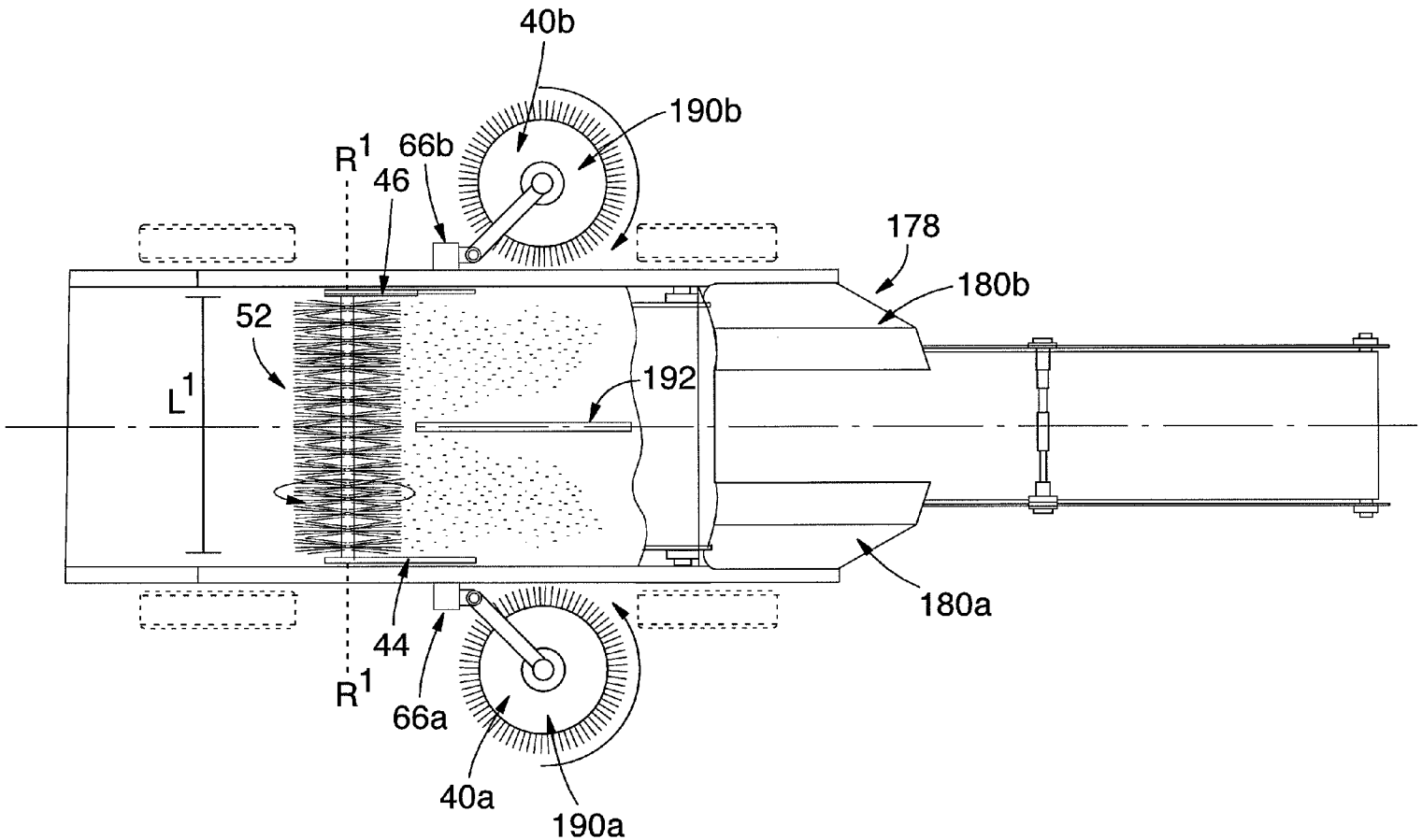
FIG. 11 is a top view of a mechanical sweeper showing the gutter brooms directing the debris toward the deflector and the pickup broom, in accordance with one embodiment of the present invention.

Referring to FIGS. 4 and 11, the pickup broom assembly 26 is mounted below the frame 22 and comprises a pair of spaced-apart support members 44, 46. Each support member 44, 46 being mirror image of one another, only support member 44 will be described throughout the description. A person skilled in the art will appreciate that a similar description also applies to support member 46. The support member 44 comprises a front end 48 pivotably mounted to the receptacle assembly 28 and a back end 50.

Mounted for rotation between the support members 44, 46, proximal to the back end 50 thereof, is a cylindrical pickup broom 52. The pickup broom 52 comprises a cylindrical shaft 54 from which are radially extending bristles 56 distributed along the entire length of the shaft 54. In one embodiment, the shaft 54 of the broom 52 has a length $L^1$ (shown in FIGS. 11 and 12) corresponding to the distance between the support members 44, 46 and comprises mounting rods (not shown) concentrically extending from each end of the shaft 54 for rotatively mounting the pickup broom 52 to the support members 44, 46. In this embodiment, the length $L^1$ ranges from about 1 foot to about 20 feet, preferably between about 3 and 15 feet, and corresponds more preferably to 5 feet. A person skilled in the art will appreciate that the length $L^1$ of the shaft 54 (or the width of the broom 52) can be adapted to the width of the surface to be cleaned and to the transport regulations or constraints relevant to circulation on surface. For instance, where regulations determine a maximum width for vehicles circulating on a type of roads (e.g. highways or secondary roads) the length $L^1$ of the shaft 54 and the width of the sweeper 20 will be adapted to comply with such regulations. On the other end, where regulations are permissive and the surface to be cleaned is wider, (e.g. on airport runways) the length $L^1$ of the shaft 54 may well exceed 20 feet.

Figure 5:
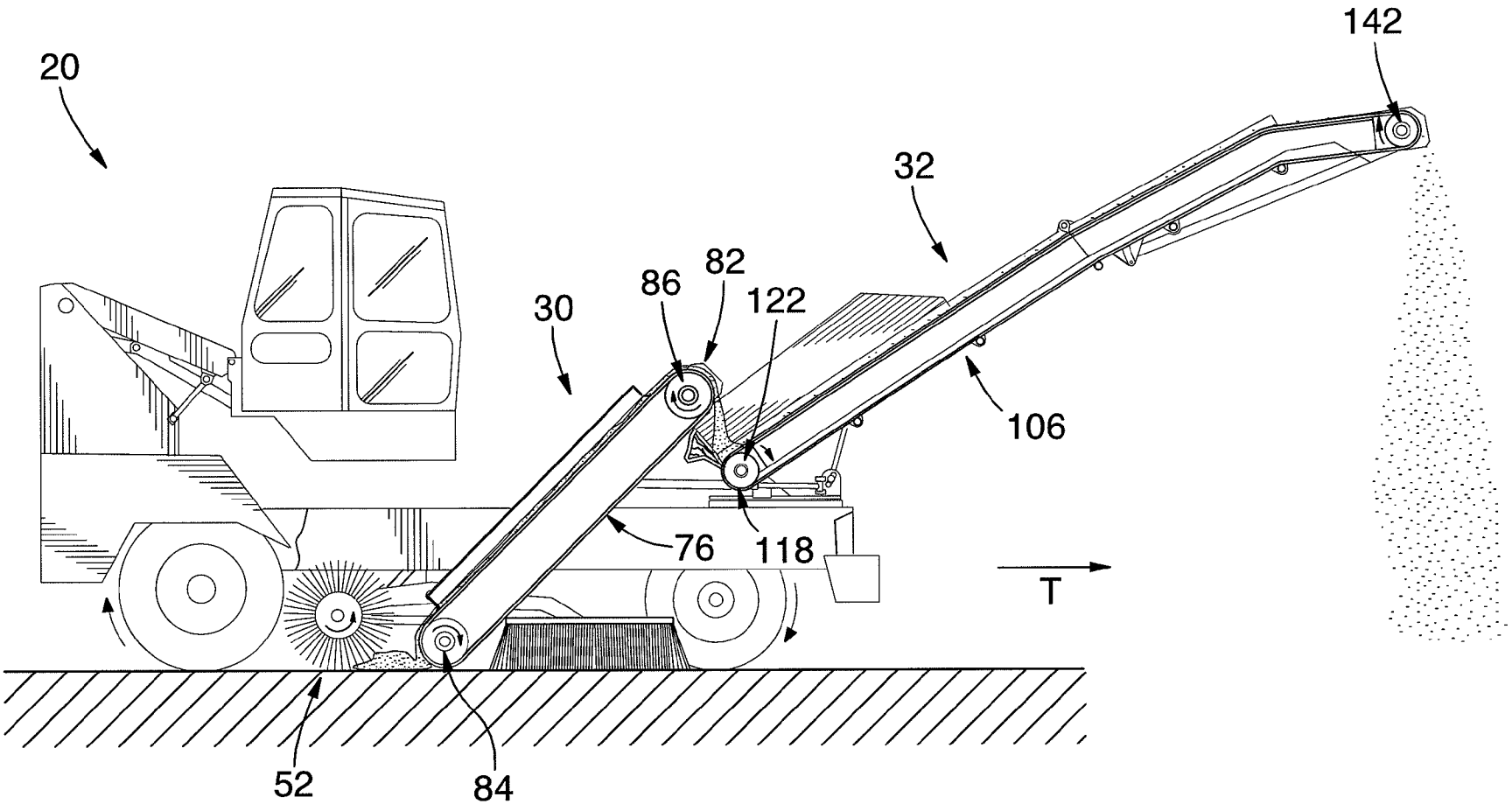
FIG. 5 is a right, partial cross-sectioned view of the mechanical sweeper shown in FIG. 1 for showing the movement of the debris on the first conveyor assembly and the deployable conveyor assembly in operation.
Figure 12:
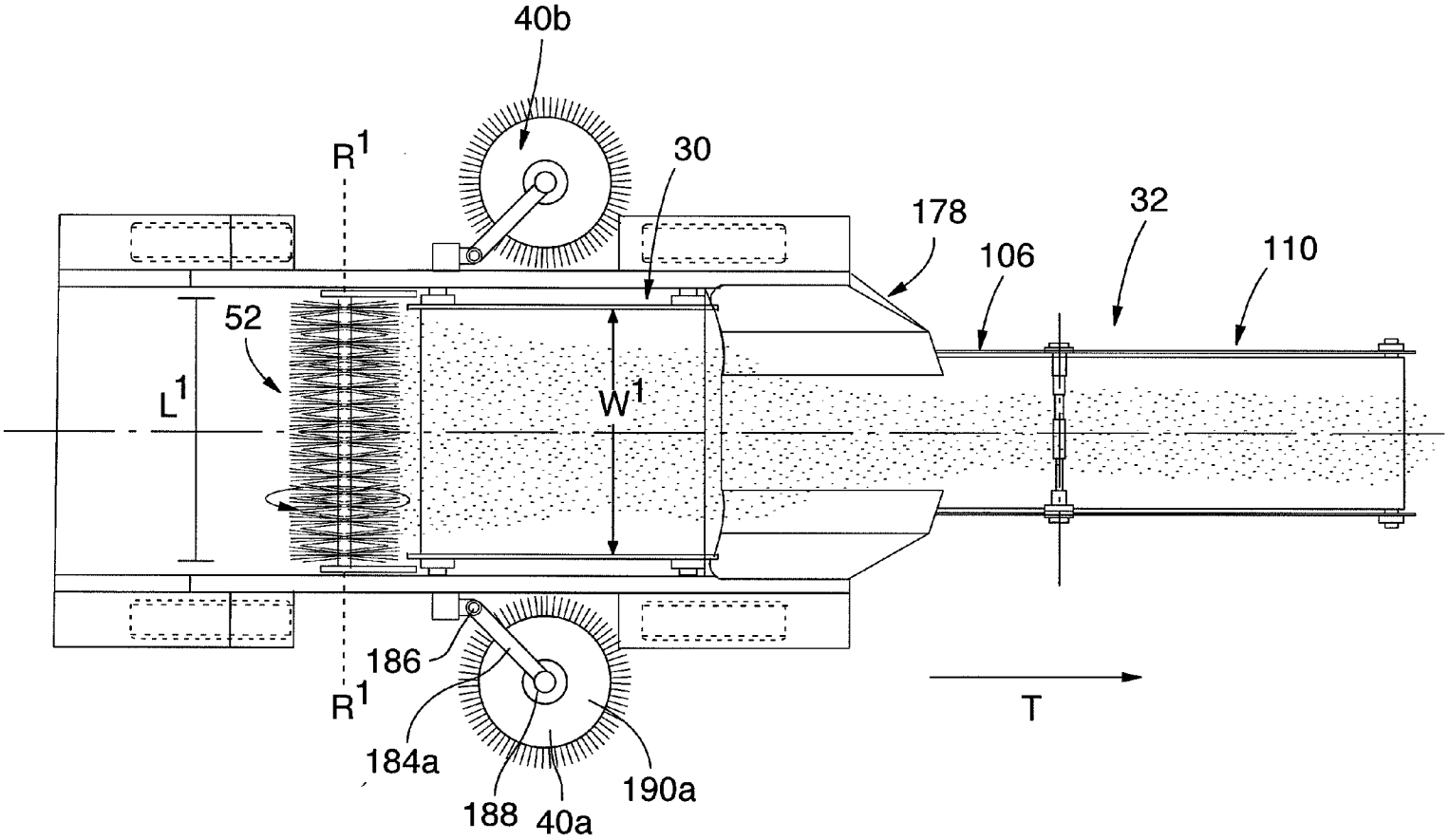
FIG. 12 is another top view of the a mechanical sweeper showing the debris lifted by the pickup broom and conveyed on the first conveyor assembly and on the second conveyor assembly.

The pickup broom 52 is configured for rotating about a horizontal rotation axis $R^1$-$R^1$, the axis $R^1$-$R^1$ being perpendicular to the travel direction T of the sweeper in operation (shown in FIGS. 11 and 12). The pickup broom assembly 26 also comprises a hydraulic motor (not shown) mounted to one of the support member 44 and 46 and operatively coupled to the pick up broom 52 for urging rotation thereof about the axis $R^1$-$R^1$. In one embodiment, the hydraulic motor (not shown) is operable to urge rotation of the pickup broom 52 in a rotation direction countersense to the rotation direction of the wheels 24 when the sweeper 20 travels forward. In other words, the motor (not shown) is operable to urge counter-clockwise rotation of the pickup broom 52, when seen from the right side of the sweeper (e.g. as shown in FIG. 5) as the mechanical sweeper travels forward on the surface to be cleaned.

Still referring to FIG. 4, the pickup broom assembly 26 is further provided with a pair of actuators 58 coupled to the frame 22 and connecting each support members 44 or 46 between the pickup broom 52 and the front end 48. The actuator 58 is adapted for adjusting the position of the pickup broom 52 relative to the receptacle assembly 28 therefore the pressure exerted by the pickup broom 52 on the surface to be cleaned by pivoting the same about the front end 48 of the support members 44, 46.

The pickup broom assembly 26 collaborates with the receptacle assembly 28 for cleaning the debris from the surface. More specifically, as the broom 52 of the pickup broom assembly 24 is rotated, the bristles 56 lift the debris and project them frontwardly, toward the receptacle assembly 28. As such, the receptacle assembly 28 is located below the frame 22, frontward from the pickup broom assembly 26.

Figure 9:
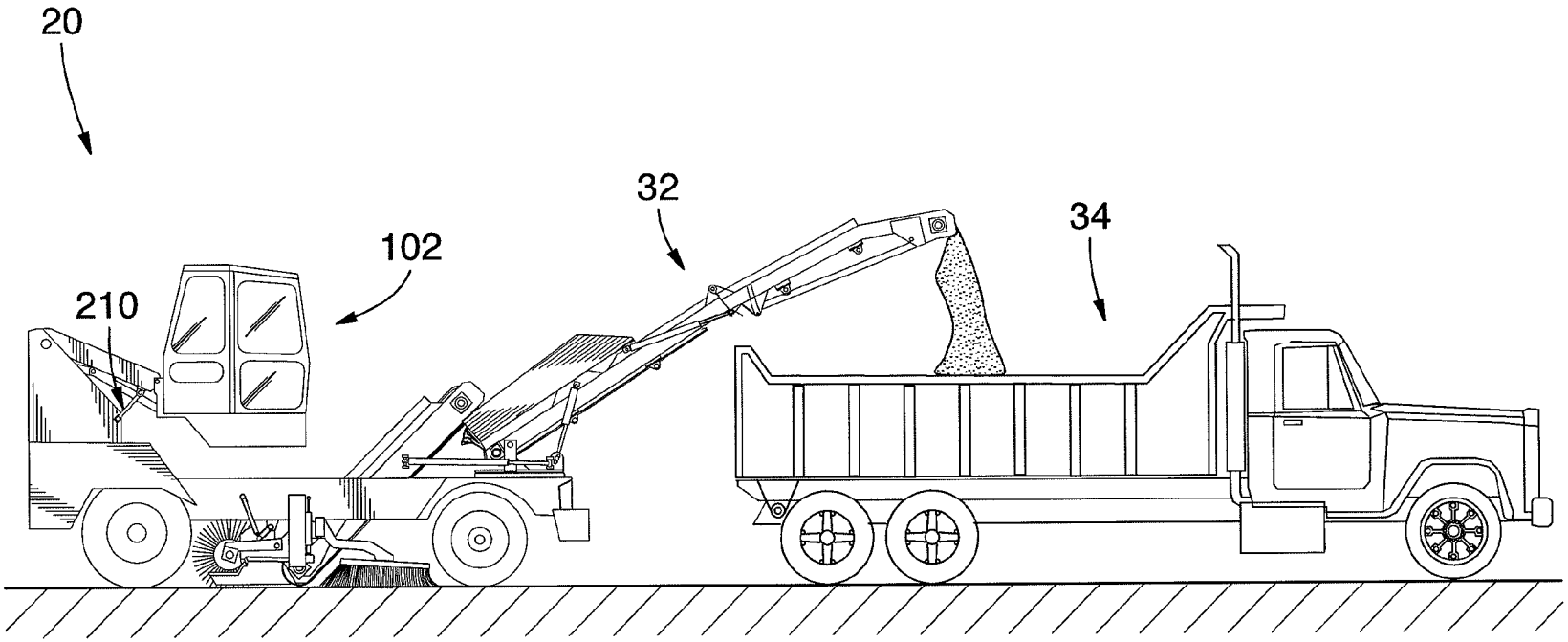
FIG. 9 is a right elevation view of a mechanical sweeper transferring debris in an auxiliary vehicle in accordance with one embodiment of the present invention, with the operator cab in lower, travel position.
Figure 10:
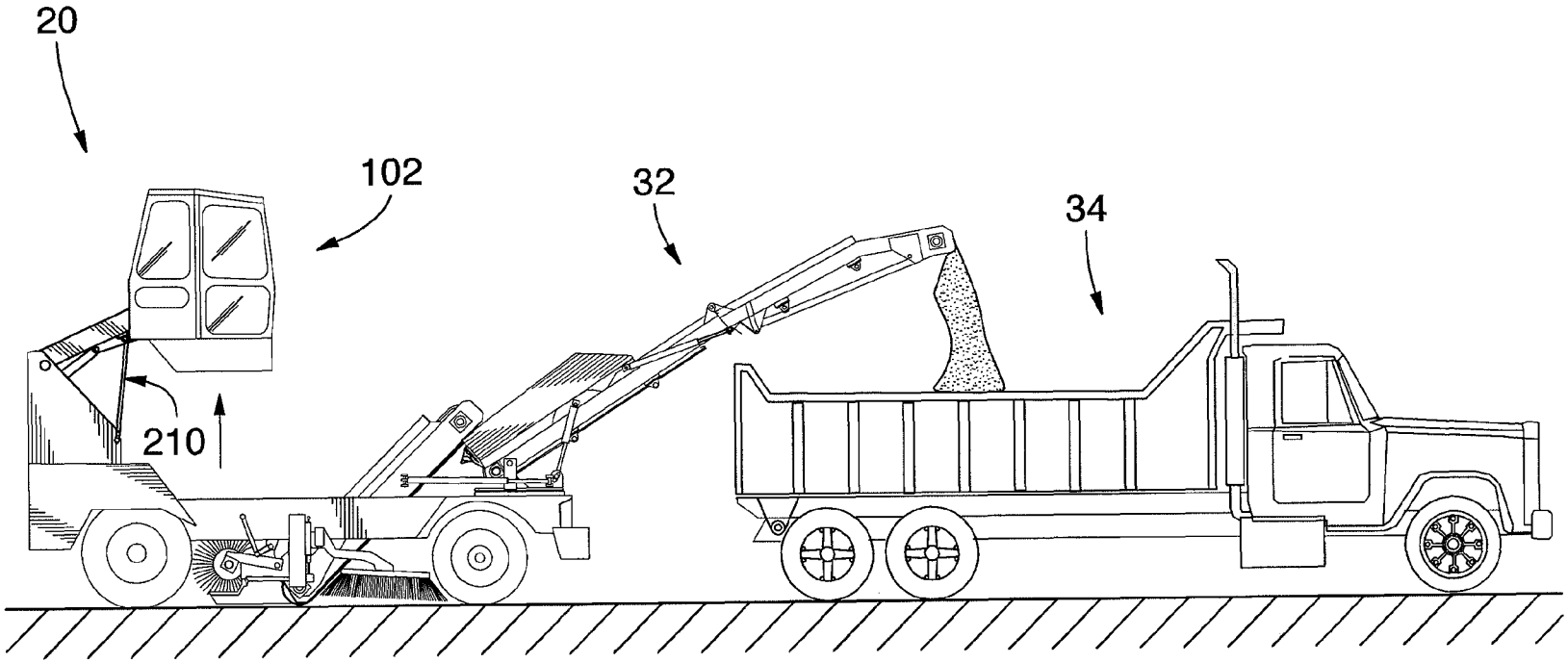
FIG. 10 is another right elevation view of the mechanical sweeper shown in FIG. 9, with the operator cab in upper, cleaning position.

Referring to FIGS. 4 and 11, the receptacle assembly 28 is similar to receptacles assemblies known in the art and comprises a hopper 60 and a pair of vertically extendible mounting members 66*a*, 66*b*. Each mounting member 66*a*, 66*b* being mirror image of one another, only mounting member 66*a* will be described. It will be appreciated that a similar description also applies to mounting member 66*b*. The mounting member 66*a* comprises an upper end 68 connected to the frame and a lower end 70 connected to the hopper 60 of the receptacle assembly 28. A hydraulic actuator 72 is connected to the upper and lower ends 68 and 70, respectively of the mounting member 66*a*, for causing extension thereof from a travel position (i.e. when the receptacle assembly 28 and the pickup broom 52 are lifted away from the surface as shown in FIGS. 1 to 4) and a cleaning position (i.e. when the receptacle and the pickup broom assemblies 28 and 52, respectively are lowered down on the surface and contact the same, as shown in FIGS. 5, 9 and 10).

Returning to FIGS. 1 to 3 and 7, the first conveyer assembly 30 comprises a frame 74 on which is rotatably mounted a conveyor belt 76. More specifically, the frame comprises two spaced-apart side members 78*a*, 78*b* connected to one another by a cross-member (not shown). The frame 74 of the conveyor assembly 30 is angularly mounted to the frame 22 of the sweeper 20 and comprises a lower end extending 80 in the receptacle assembly 28 (i.e. below the frame 22 of the sweeper 20) and an upper end 82 extending above the frame 22 of the sweeper 20. In one embodiment, the frame 74 of the first belt conveyor 30 defines an angle $\theta^1$ of approximately 60° with the frame 22 of the sweeper 20. A person skilled in the art will appreciate that the angle $\theta^1$ may be different. For instance, angle $\theta^1$ may be adjusted according to the configuration of the sweeper and the room available for positioning such first belt conveyor 30. For instance, where the frame 22 of the sweeper 20 is shorter and less room is available, the first belt conveyor 30 may be positioned at a higher angle (e.g. about 80°) while where the frame 22 is longer and more room is available, the angle $\theta^1$ may be reduced (e.g. about 45°).

Mounted at the lower and upper ends 80, 82 of the frame 74 are two parallel rollers 84, 86, each roller 84, 86 being configured for rotation about a horizontal axis (shown in FIG. 5). In one embodiment, at least one of the rollers 84, 86 is coupled to a hydraulic motor (not shown) for urging rotation thereof and thereby driving rotation of the belt 76.

In one embodiment, the rotation direction of the rollers 84, 86 is opposed to the rotation direction of the pickup broom 56. As the sweeper 20 travels forward, the rollers 84,86 of the first conveyor assembly 30 rotate clockwise (when seen from the right side of the vehicle, as shown in FIG. 5).

Mounted on the rollers 84, 86 is the belt 76. In one embodiment, the belt 76 is preferably a rubber belt carrying a plurality of V-shaped protrusions 88 (shown in FIG. 6) for enhancing the gripping properties of the belt 76 over debris as the sweeper 20 is operated. The belt 76 has a top portion 90 and a bottom portion 92. A person skilled in the art will appreciate that the belt 76 could be made from any suitable material. Further, such a conveyor belt 76 could be exempt of protrusions or, when present, such protrusions 88 may have a different shape.

In one embodiment, the belt 76 of the first conveyor assembly 30 has a width $W^1$ corresponding to the length $L^1$ of the pickup broom 52 (shown in FIG. 12). As such, the width $W^1$ of the belt 76 preferably ranges between about 1 and 20 feet, preferably between about 3 and 15 feet, and more preferably has a width of 5 feet. A person skilled in the art will appreciate that the length $W^1$ of the belt 76 is adapted to the lengths $L^1$ of the shaft 54 and, similarly, can be adapted to the width of the surface to be cleaned and to the transport regulations or constraints relevant to circulation on surface. As it will become apparent below, the first conveyor assembly 30 is configured to capture the debris from the receptacle assembly 28 and to convey the same toward the second, deployable conveyor assembly 32.

Figure 6:
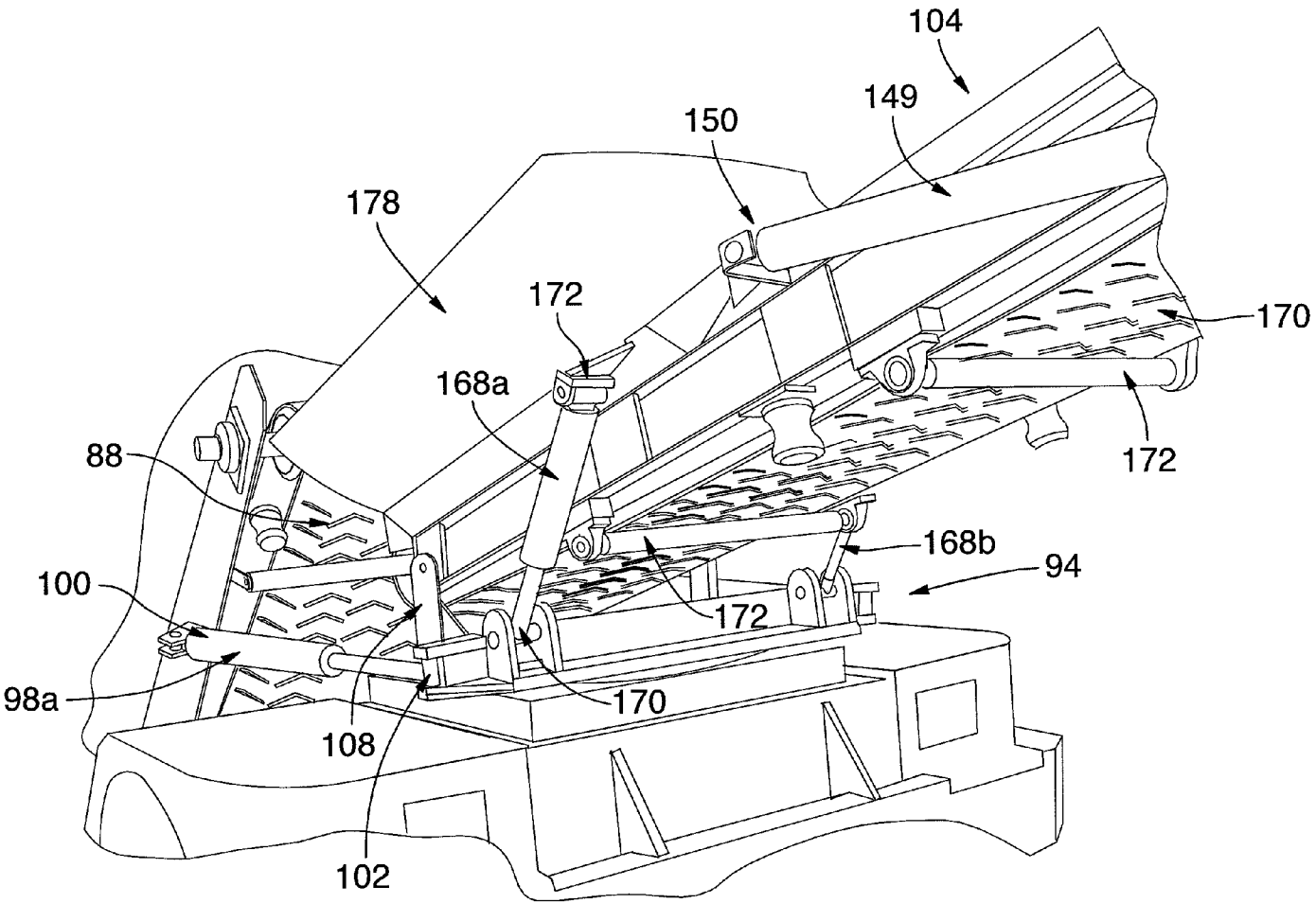
FIG. 6 is an enlarged front right perspective view of a turntable of the deployable conveyor of the mechanical sweeper, according to one embodiment of the present invention.

The deployable conveyor assembly 32 comprises a turntable 94 rotatably mounted on the frame 22 of the sweeper 20, proximal to the front end 96 of the sweeper 20 (best shown in FIGS. 6 and 7). The turntable 94 comprises a vertical pivot axis $R^2$-$R^2$ about which the deployable conveyor assembly 32 can be pivoted, between the left and right sides of the sweeper 20 (best shown in FIG. 7). For causing rotation thereof about the $R^2$-$R^2$ axis, the turntable 94 is coupled to a pair of hydraulic actuators 98*a*, 98*b*. The hydraulic actuators 98*a*, 98*b* being similar to one another, only hydraulic actuator 98*a* will be described. It will be understood that a similar description also applies to hydraulic actuator 98*b*. The hydraulic actuator 98 has a back end 100 mounted to the frame 74 of the first conveyor assembly 30 and a front end 102 coupled to the turntable 94. When a first hydraulic actuator (e.g. actuator 98*a*) is extended and the other hydraulic actuator (e.g. actuator 98*b*) is retracted, the turntable 94 is forced to rotate towards the left side of the sweeper 20 and displace the deployable conveyor assembly 32 towards the same direction. At the opposite, when the first hydraulic actuator (e.g. actuator 98*a*) is retracted and the other hydraulic actuator (e.g. actuator 98*b*) is extended, it causes the turntable to move in the opposite direction, thus displacing the deployable conveyor assembly 32 towards the right of the sweeper 20. A person skilled in the art will appreciate that the turntable 94 could be configured differently. For instance, pivoting about the vertical $R^2$-$R^2$ axis could be provided by using only one hydraulic actuator. Further, rack and pinion means or other actuator means known in the art could replace the hydraulic actuators 98*a*, 98*b*.

Referring to FIGS. 1 to 3 and 8, the deployable conveyor assembly 32 also comprises a deployable conveyor 104 mounted on the turntable 94. In one embodiment, the deployable conveyor 104 comprises a back portion 106 pivotably connected to the turntable 94 via a hinge bracket 108, and a front portion 110 articulately mounted to the back portion 106, as best described below.

The back portion 106 comprises a pair of spaced-apart frame members 112*a*, 112*b* connected to one another by a cross-member (not shown) and having a top side 114 and a bottom side 116. The back portion 106 also comprises a back end 118, and an opposed front end 120. Mounted between the frame members 112*a*, 112*b*, at the back end 118 of the back portion 106, is a roller 122 adapted for rotation about a horizontal rotation axis.

As best shown in FIG. 5, the back end 118 of the back portion 106 is positioned below the upper end 82 of the first conveyor assembly 20, for receiving debris conveyed by the first conveyor assembly 30 during operation of the sweeper 20.

Now returning to FIGS. 1 to 3 and FIG. 8, the back portion 106, at the front end 120 thereof, is provided with a hinge bracket 122 extending from the bottom side 116 of the frame members 112*a*, 112*b* and a lock bracket 124 extending from the top side 114 of the frame members 112*a*, 112*b*. The hinge bracket 122 comprises two pairs of spaced-apart plates 126*a*, 126*b* and 128*a*, 128*b*, each pair extending downwardly from the bottom side 116 of a corresponding frame member 112*a*, 112*b*, respectively. The plates 126*a*, 126*b* of the hinge bracket 122 are provided with horizontally aligned holes (not shown) for receiving therein pins 130 for pivotably mounting the front portion 110 of the deployable conveyor assembly 32 to the back portion 106, as best described below The lock bracket 124 comprises two lock plates 132*a*, 132*b*, each lock plate extending upwardly from the top side 114 of one corresponding frame member 112*a*, 112*b* and projecting slightly forwardly from the front end 120 of the frame members 112*a*, 112*b*. Each plate 132*a*, 132*b* is provided with a circular hole 134*a*, 134*b*, the holes 134*a*, 134*b* of the two plates 132*a*, 132*b* being horizontally aligned to one another.

Similarly to the back portion 106, the front portion 110 of the deployable conveyor assembly 32 comprises a pair of spaced-apart frame members 136*a*, 136*b* connected to one another by a cross-member (not shown). Each frame member 136*a*, 136*b* comprises a back end 138 and a front end 140. Mounted for rotation between the frame members 136*a*, 136*b*, at the front end 140 thereof, is a roller 142 (shown in FIG. 5).

Figure 8:
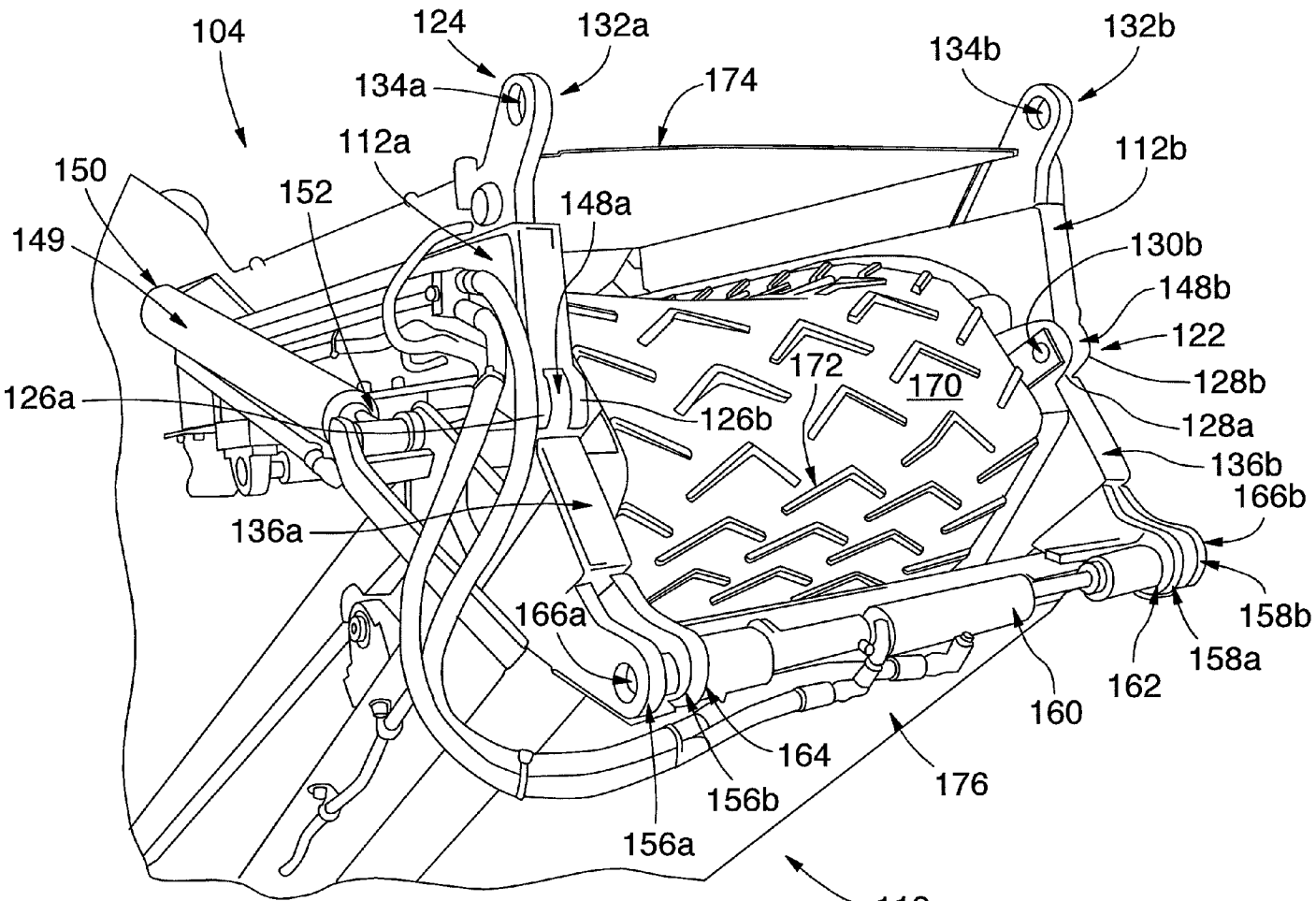
FIG. 8 is a front right perspective view of the junction between the back portion and the front portion of the deployable conveyor according to one embodiment of the present invention.

As best shown in FIGS. 3 and 8, the frame member 136*a* of the front portion 110 is slightly bending between the back and front ends 138, 140 to define a back linear portion 142 and a front linear portion 144. The frame member 136*b* has a similar configuration. As it will become apparent below, this configuration reduces the angle of the front end of the deployable conveyor assembly 32, relative to the auxiliary truck 34 receiving the material from the sweeper 20 when the conveyor assembly 32 is fully deployed.

The front portion 110 comprises a hinge bracket 146 comprising two plates 148*a*, 148*b*, each plate extending downwardly from the bottom side of one frame member 132*a*, 132*b* and having a hole (not shown) extending therethrough. Once the front portion 110 of the deployable conveyor 32 is assembled to the back portion 106, each plate 148*a*, 148*b* of the front portion 110 is received between the corresponding plates 126*a*, 126*b* or 128*a*, 128*b* of the back portion 106, and the corresponding holes aligned. The pins 130 are then secured in the hinge brackets 122 and 146, thereby enabling the front portion 110 of deployable conveyor assembly 142 to pivot upwardly and downwardly relative to the back portion 106, between a folded position (shown in FIG. 1) and a deployed position (shown in FIG. 3).

For urging deployment thereof, the deployable conveyor assembly 32 is provided with a pair of hydraulic actuators 149 mounted on each side of the frame members 112*a*, 112*b*. Each hydraulic actuator 149 has a back end 150 operatively connected to one frame member 112*a*, 112*b* of the back portion 106 and a front end 152 operatively connected to one corresponding frame member 136*a*, 136*b* of the front portion 110. When the hydraulic actuators 149 are in a retracted position, the front portion 110 is positioned downwardly, in the folded position (shown in FIGS. 2 and 3). As the actuators 149 are actuated toward an extended position, they force the front portion 110 to pivot upwardly toward the deployed position (as best shown in FIG. 4).

To maintain the deployable conveyor assembly 32 in the deployed configuration during cleaning operation of the sweeper 20, the front portion 110 is provided with a lock assembly 154, shown in FIG. 8. The lock assembly 154 comprises two pairs of spaced-apart plate members 156*a*, 156*b* and 158*a*, 158*b* extending upwardly from the top side of frame members 132*a*, 132*b*, slightly frontwardly, and a lock actuator 160 mounted between the two pairs of plate members 156*a*, 156*b* and 158*a*, 158*b*, and operatively connected thereto. The lock actuator 160 comprises a left and a right end 162, 164, each end carrying a lock pin (not shown), the lock pin being configured to fit within corresponding holes 166*a*, 166*b* in the plate members.

When the conveyor assembly 32 is in deployed position, the plate members 132*a*, 132*b* of the back portion 106 are received between two corresponding plate members 156*a*, 156*b* and 158*a*, 158*b* of the front portion 110, the holes 134*a*, 134*b* and 166*a*, 166*b* of the back and front plate members 132*a*, 132*b*, 156*a*, 156*b* and 158*a*, 158*b* being aligned. The lock actuator 160 is then actuated. As it extends, the lock pins (not shown) move toward each side of the conveyor, inside the aligned holes of the lock bracket 124 and lock assembly 152 therefore preventing downward movement of the front portion 110, toward the folded position.

As best shown in FIG. 2, the back portion 106 of the deployable conveyor assembly 32 is generally horizontal when the conveyor 32 is completely folded, while it defines an angle $\theta^2$ relative to the frame 22 of the sweeper 20 when partially deployed (FIG. 2) or fully deployed (FIG. 3). As such, the front end 120 of the back portion 106 can move upwardly and downwardly. To move the back portion 106 upwardly and downwardly, the deployable conveyor assembly is provided with a pair of hydraulic actuators 168*a*, 168*b* (shown in FIGS. 1 to 3 and 6). Each actuator 168*a*, 168*b* has a lower end 170 operatively connected to the turntable 94 and an upper end 172 coupled to a frame member 112*a*, 112*b* of the back portion 106. When the actuators 168*a*, 168*b* are retracted, the back portion 106 becomes generally horizontal, while when the actuators 168*a*, 168*b* are extended, they force the back portion 106 to pivot upwardly.

Mounted on the back and front portions 106, 110 of the deployable conveyor 104 is a conveyor belt 170 (FIGS. 1 to 3 and 6). The conveyor belt 170 extends from the back end 118 of the back portion 106 to the front end 140 of the front portion 110 and is operable to rotate about the roller 122 of the back portion 106 and the roller 142 of the front portion 110 when the conveyor 32 is deployed. For urging rotation of the belt 170, the roller 122 of the back portion 106 is coupled to a hydraulic motor (not shown). A person skilled in the art will appreciate that both the back and front rollers 122 and 142 could be coupled to a hydraulic motor.

In one embodiment, the belt 170 is a rubber belt carrying V-shaped protrusions 172 for enhancing the grip of the belt 170 over the material conveyed thereon (shown in FIG. 8). Similarly to the belt 76 of the first conveyor assembly 30, the belt 170 could be made from any suitable material. Further, such a conveyor belt 170 could be exempt of protrusions or, when present, such protrusions 172 may have a different shape.

A person skilled in the art will appreciate that when the deployable conveyor assembly 32 is in folded configuration (as shown in FIG. 1), the belt 170 may sag or slack from the bottom side 116 of the back portion 106, which may impair proper positioning of the belt 170 during deployment of the conveyor assembly 32. To avoid such sagging of the belt 170 and maintain the same into position during folding and deployment of the conveyor assembly 32, the back and front portions 106, 110 are provided with auxiliary rollers 172. Each auxiliary roller extends between the frame members, on the bottom side thereof. The back and front portions 106, 110 of the deployable conveyor may also comprise guard means 174, 176 mounted on the frame members 112*a*, 112*b* and 132*a*, 132*b*, respectively for controlling the movement of the debris conveyed on the belt 170 and avoid unwanted falling thereof during the operation of the sweeper 20 (shown in FIG. 8).

In one embodiment of the present invention, the belt 170 of the deployable conveyor assembly 32 has a width $W^2$ ranging from about 6 inches to about 6 feet, and preferably from about 1 foot to about 4 feet and has preferably a width of 32 inches. A person skilled in the art will appreciate that the width $W^2$ of the deployable conveyor assembly 32 is smaller than the width $W^1$ of the belt 76 of the first conveyor assembly 30. To direct or funnel the debris falling from the upper end 82 of the first conveyor 30 on the belt 170 of the deployable conveyor assembly 32, a chute 178 is mounted on the frame members 112*a*, 112*b* of the back portion 106 (shown in FIGS. 3, 6 11 and 12). The chute 178 comprises a pair of sidewalls 180*a*, 180*b* made from a flexible material such as rubber, each sidewall 180*a*, 180*b* angularly extending from the top side of a frame member 112*a*, 112*b*, proximal to the back end 118 thereof. The chute 178 also comprises a back wall 182 comprising a row of bristles extending upwardly to contact the belt 76 of the first conveyor 30. A person skilled in the art will appreciate that the chute 178 could be made from any other suitable material and that such chute may take different configurations.

While the second, deployable conveyor assembly 32 has been described in connection with one embodiment, a person skilled in the art will appreciate that multiple deployable conveyor configurations would be possible. For instance, rather than providing a hinge assembly (e.g. hinge brackets 122 and 146), the front portion 110 of the deployable conveyor assembly could be mounted to the back portion 106 via a slide mechanism (not shown) or other coupling means. Where such a slide mechanism is provided, the deployable conveyor assembly would be telescopically deployed and folded rather than being provided with a pivoting-type deployment assembly. In such an embodiment, retracting or folding of the second portion may render impractical the use of a single belt such as belt 170 as it may tend to loosen or slack. Therefore, one may opt for using an individual belt on each of the back and front portions rather then using a single belt.

In one embodiment of the present invention, the mechanical sweeper 20 is provided with the gutter broom assemblies 40*a*, 40*b* for directing debris toward the pickup broom 52 shown in FIGS. 1, 4, 7, 11 and 12). In this embodiment, each gutter broom assembly 40*a*, 40*b* comprises a mounting member 184 having a back end 186 connected to the extending member 66*a* of the receptacle assembly 128 for pivot about a vertical axis, and a front end 188. The front end 188 carries a broom 190 configured to rotate about a vertical axis and a hydraulic motor (not shown) coupled to the broom 190 for urging rotation thereof. A hydraulic actuator (not shown) is coupled to the frame 22 of the sweeper 70 and to the mounting member 184 and is operable to cause the gutter brooms to move between a closed position (as shown in FIG. 7) and an open position (as shown in FIGS. 11 and 12).

The gutter brooms 190*a*, 190*b* rotate countersense from one another so as to direct the debris toward the opposite side of the sweeper. To stop the course of such debris toward the opposite side of the sweeper, a deflector 192 can be provided. As known in the art, the angle of the gutter brooms 190*a*, 190*b* relative to the surface to be cleaned can be adjusted to optimize directing debris toward the deflector 192. For instance, the gutter brooms 190*a*, 190*b* can be inclined such that only a portion thereof will contact the surface to be cleaned.

Now returning to FIGS. 1 and 2, the operator cab assembly 38 will be described in accordance with one embodiment of the present invention. According to this embodiment, the cab assembly 38 is mounted at the back end of the frame 22 and comprises a pair of spaced-apart mounting bracket 200 extending upwardly from the frame 22 of the sweeper 20, parallel to one another. Each bracket 200 comprises a bottom end 202 welded or otherwise fastened to the frame 22 and a tapering top end 204.

The cab assembly further comprises a cab 206 mounted to the brackets 200 by a lift arm assembly 208 and a pair of hydraulic actuators 210 coupled to the bracket 200 and to the lift arm assembly 208. The hydraulic actuators 210 are operable for causing the cab 206 to move between a lower, travel position (as shown in FIG. 9) and an upper, cleaning position (shown in FIG. 10).

The cab 206 is provided with a steering wheel (not shown) operatively connected to the wheels 24 of the sweeper 20 for controlling the direction thereof, and with controls for actuating the various components of the sweeper 20. A person skilled in the art will appreciate that many other cab configurations are possible. For instance, the cab assembly could be positioned beside the deployable conveyor assembly 32, at the front end of the sweeper 20.

The drive assembly (not shown) of the sweeper 20 comprises a main motor and a transmission for coupling the motor to the wheels 24 of the vehicle. In one embodiment, the main motor is a diesel engine and the transmission is a hydrostatic transmission. A person skilled in the art will appreciate that such a diesel engine could be replaced by a gas motor, an electric motor and the like and that the hydrostatic transmission may be replaced by chain and sprockets, belt and pulleys, or gears and shaft transmissions.

The transmission is also adapted for coupling the main motor to a hydraulic pump. The hydraulic pump is coupled to the various hydraulic actuators and motors by hydraulic hoses and is operable for driving actuation thereof. A person skilled in the art will appreciate that the hydraulic pump may alternatively be coupled to an auxiliary motor rather than being coupled to the main motor.

Having described the general configuration of the sweeper 20, its operation will now be described. According to one embodiment, the sweeper 20 is in a travel configuration when it travels from one operation site to another. When the sweeper 20 is in such a travel configuration, the operator cab is in lower, travel position, the deployable conveyor assembly 32 and the gutter brooms 40*a*, 40*b* are in folded configurations (as best shown in FIG. 1). This enables the sweeper 20 to travel safely on roads, highways and the like with a speed up to 100 km/h, thereby reducing the time spent for traveling from one site to another.

Once the mechanical sweeper 20 has reached the operation site, the operator actuates the various components of the sweeper to adopt the operation or cleaning configuration (shown in FIGS. 1 to 3 and 10 to 12). More specifically, the operator actuates the hydraulic actuators 168*a*, 168*b* of the deployable conveyor 32 for lifting the front end 120 of the back portion 106 of the deployable conveyor assembly 32. As the front end 120 of the back portion 106 reaches the upper position (shown in FIG. 2), the front end 140 of the front portion 110 of the deployable conveyor 32 is caused to move upwardly, toward the fully deployed configuration, by actuating the hydraulic actuators 149 toward the extended position. Once the deployable conveyor is fully deployed (as shown in FIG. 3), the hydraulic actuator 160 of the lock assembly 154 is urged to extend, thereby forcing the locking pins to enter the holes 134*a*, 134*b* and 166*a*, 166*b* of the brackets 132*a*, 132*b*, 156*a*, 156*b* and 158*a*, 158*b* and locking the front portion 110 of the deployable conveyor 32 into the fully deployed configuration (shown in FIG. 3).

The operator then turns to deploy the gutter brooms assemblies 40*a*, 40*b* on each side of the sweeper 20. More specifically, the hydraulic actuators (not shown) are extended, thereby causing the mounting members 184*a*, 184*b* to pivot and the gutter brooms 190*a*, 190*b* attached thereto to move laterally, away from one another, and downwardly to contact the surface to be cleaned. As it will become apparent below, deployment of the gutter brooms 190*a*, 190*b* enables extending the width of the cleaning surface beyond the length $L^1$ of the pickup broom 52.

The sweeper 20 is then moved frontwardly, toward the dump truck 34, in which the debris collected by the sweeper 20 will be transferred, as it will become apparent below. As best shown in FIG. 9, the front end 140 of the deployable conveyor assembly 32 is located above the dump body of the dump truck 34, such that debris falling therefrom will be received in the dump body. The operator can modify the angle of the deployable conveyor assembly 32 by controlling the hydraulic actuators 168*a*, 168*b* to reduce or increase the distance between the deployable conveyor and the dump body of the truck as the sweeper is operated.

To have a better vision during cleaning operations, the operator may further actuate the hydraulic actuators 210 of the cab assembly 38 to move the cab 206 from the lower position toward the upper position (shown in FIG. 10). A person skilled in the art will appreciate that the sweeper can also be operated with the cab in lower position, for instance when operating under structure having a limited height such as bridges, viaducts and the like.

For cleaning the surface, the hydraulic motors of the gutter and pickup brooms assemblies 26, 40*a* and 40*b* are actuated. The gutter brooms 190*a*, 190*b* rotate countersense from one another to direct the debris on each side of the sweeper toward the deflector 192, which deflector 192 stops the debris and keep the same in the course of the pickup broom 52 (shown in FIG. 11). The pickup broom 52 then lifts the debris and moves them towards the receptacle assembly 28. The debris are then captured from the receptacle assembly 28 by the conveyor belt 76 of the first conveyor assembly 30, at the lower end 80 thereof, and conveyed toward the upper end 82 thereof (FIGS. 11 and 12). The debris then fall from the upper end 82 of the first conveyor assembly 30, into the chute 178, which directs the debris toward the back end 118 of the deployable conveyor assembly 32, which in turn conveys the debris toward the dump truck 34 (as shown in FIG. 10).

When a sufficient amount of debris has been conveyed into the dump truck 34, the operator of the sweeper 20 signals the operator of the truck 34, which then leaves the operation site to travel to the landfill where the truck 34 will be emptied. During the travel time of the dump truck toward the landfill, another dump truck is positioned for receiving the debris from the sweeper 20. To facilitate movement of the trucks relative to the sweeper 20, the deployable conveyor assembly 32 may be pivoted laterally towards the left or right sides thereof (shown in FIG. 7).

Once the cleaning operations are completed, the operator cab 206 is lowered, the gutter brooms 190 retracted and the deployable conveyor folded for the mechanical sweeper 20 to travel from the operation site toward another operation site.

Although the foregoing description and accompanying drawings relate to specific preferred embodiments of the present invention as presently contemplated by the inventor, it will be understood that various changes, modifications and adaptations may be made.

The invention claimed is:

1. A self-propelled mechanical sweeper for cleaning debris from a surface, said mechanical sweeper comprising:

a frame mounted on wheels for motion on said surface;

a pickup broom assembly mounted to said frame for lifting said debris from said surface;

a first belt conveyor mounted to said frame for collecting said debris lifted by said pickup broom assembly and conveying the same away from said surface;

a deployable conveyor assembly mounted to said frame and operable for conveying debris conveyed by said first conveyor toward another vehicle, said deployable conveyor assembly comprising:

a first conveyor portion comprising a coupling means;

a second conveyor portion mounted to said first conveyor portion via said coupling means, said coupling means enabling movement of said second portion relative to said first portion between a folded position and an extended position;

at least one belt operatively mounted on said first conveyor portion and said second conveyor portion and operable for motion thereon;

an actuator assembly mounted to said deployable belt conveyor for urging said movement of said second conveyor portion between said folded position and said extended position; and a drive assembly mounted to said frame for driving operation of said pickup broom, said first belt conveyor, said deployable conveyor assembly and said actuator assembly.

2. The mechanical sweeper of claim 1, said first conveyor portion comprising a first end and a second opposed end, said second conveyor portion comprising a first end and a second opposed end, said first end of said second conveyor portion being connected to said second end of said first conveyor portion via said coupling means.

3. The mechanical sweeper of claim 2, wherein said coupling means is a hinge assembly.

4. The mechanical sweeper of claim 2, wherein said deployable conveyor assembly is mounted to said frame for pivot movement about a vertical axis.

5. The mechanical sweeper of claim 4, wherein said vertical axis is located proximal to said first end of said first conveyor portion.

6. The mechanical sweeper of claim 5, further comprising an actuator assembly for urging pivoting of said deployable conveyor assembly about said vertical axis.

7. The mechanical sweeper of claim 2, wherein said deployable conveyor assembly is mounted to said frame for pivot movement about a horizontal axis.

8. The mechanical sweeper of claim 7, wherein said horizontal axis is located proximal to said first end of said first conveyor portion.

9. The mechanical sweeper of claim 8, further comprising an actuator assembly for urging pivoting of said deployable conveyor assembly about said horizontal axis.

10. The mechanical sweeper of claim 1, wherein said coupling means is a slide mechanism.

11. The mechanical sweeper of claim 1, wherein said mechanical sweeper further comprises at least one gutter broom assembly mounted to said frame for rotation about a vertical axis, said at least one gutter broom being operable to contact said surface and to direct debris toward said pickup broom assembly.

12. The mechanical sweeper of claim 11, wherein said mechanical sweeper further comprises a deflector mounted to said frame, said deflector being adapted for controlling the movement of said debris directed by said at least one gutter broom and directing the same toward said pickup broom assembly.

13. The mechanical sweeper of claim 1, further comprising an operator cab mounted to said frame.

14. The mechanical sweeper of claim 13, wherein said operator cab is mounted to said frame for movement between a lower position and an upper position.

15. The mechanical sweeper of claim 14, further comprising an actuator assembly for urging movement of said operator cab between said lower position and said upper position.

16. A self-propelled mechanical sweeper for cleaning debris from a surface, said mechanical sweeper comprising:

a frame mounted on wheels for motion on said surface;

a pickup broom assembly mounted to said frame for lifting said debris from said surface;

a first belt conveyor mounted to said frame for collecting said debris lifted by said pickup broom assembly and conveying the same away from said surface;

a deployable conveyor assembly mounted to said frame and operable for conveying debris conveyed by said first conveyor toward another vehicle, said deployable conveyor assembly comprising:

a first conveyor portion comprising a first end mounted to said frame and a second opposed end comprising a hinge assembly;

a second conveyor portion comprising a first end connected to said hinge assembly and a second end for pivoting relative to said first conveyor portion between a folded position and an extended position;

a belt operatively mounted on said first conveyor portion and said second conveyor portion and operable for continuous motion thereon;

an actuator assembly mounted to said deployable belt conveyor for urging pivot of said second conveyor portion between said folded position and said extended position; and a drive assembly mounted to said frame for driving operation of said pickup broom, said first belt conveyor, said deployable conveyor assembly and said actuator assembly.

* * * * *